US008671866B2

(12) United States Patent
Peuziat et al.

(10) Patent No.: US 8,671,866 B2
(45) Date of Patent: Mar. 18, 2014

(54) SYSTEM FOR LOADING/UNLOADING A VEHICLE INTO/FROM A CARRIER SHIP, AND CORRESPONDING CARRIER SHIP

(75) Inventors: Christian Peuziat, Douarnenez (FR); Bernard Paugam, Lorient Cedex (FR)

(73) Assignees: DCNS (FR); Etablissements Bopp Treuils Jeb (FR)

( * ) Notice: Subject to any disclaimer, the term of this patent is extended or adjusted under 35 U.S.C. 154(b) by 45 days.

(21) Appl. No.: 13/498,080

(22) PCT Filed: Sep. 2, 2010

(86) PCT No.: PCT/FR2010/005182

§ 371 (c)(1),
(2), (4) Date: Jul. 31, 2012

(87) PCT Pub. No.: WO2011/036369

PCT Pub. Date: Mar. 31, 2011

(65) Prior Publication Data

US 2012/0285360 A1 Nov. 15, 2012

(30) Foreign Application Priority Data

Sep. 24, 2009 (FR) ..... 09 56602

(51) Int. Cl.
*B63B 35/44* (2006.01)

(52) U.S. Cl.
USPC ..... 114/258; 114/259

(58) Field of Classification Search
USPC ..... 114/258, 259; 108/53.1
See application file for complete search history.

(56) References Cited

U.S. PATENT DOCUMENTS

| | | | | |
|---|---|---|---|---|
| 4,864,957 | A * | 9/1989 | Edgar et al. | 114/258 |
| 5,253,605 | A * | 10/1993 | Collins | 114/259 |
| 6,513,442 | B1 * | 2/2003 | Miller et al. | 108/53.1 |
| 2008/0202405 | A1 * | 8/2008 | Kern | 114/259 |
| 2012/0285360 | A1 * | 11/2012 | Peuziat et al. | 114/259 |

FOREIGN PATENT DOCUMENTS

| | | |
|---|---|---|
| BE | 842 166 | 11/1976 |
| DE | 90 02191 U1 | 4/1990 |
| DE | 44 31 542 | 4/1995 |
| DE | 10-2004-058824 | 6/2006 |
| FR | 2660915 | 10/1991 |
| WO | WO 00/20303 | 4/2000 |

OTHER PUBLICATIONS

Int'l Search Report and Written Opinion issued in App. No. PCT/FR2010/051827 (2010).

* cited by examiner

*Primary Examiner* — Lars A Olson
*Assistant Examiner* — Jovon Hayes
(74) *Attorney, Agent, or Firm* — Barnes & Thornburg LLP

(57) ABSTRACT

The disclosure relates to a system for loading/unloading a vehicle into/from a carrier ship through at least one opening provided in the rear of said ship comprising an angled vehicle-receiving ramp combined with a motor-driven means for loading/unloading the vehicle, characterized in that the motor-driven means for loading/unloading the vehicle comprises a crossbeam-shaped means for the ship that extends above the ramp and is combined with a vehicle-hoisting/releasing cable, which is in turn combined with a first drive means for hoisting/releasing the vehicle, and in that the crossbeam-shaped means is longitudinally movable, by means of a second drive means above the ramp, between a rear position for hoisting/releasing the vehicle and a front position for storing the vehicle on the ramp in the ship.

10 Claims, 8 Drawing Sheets

SYSTEM FOR LOADING/UNLOADING A VEHICLE INTO/FROM A CARRIER SHIP, AND CORRESPONDING CARRIER SHIP

The present disclosure relates to a system for loading/unloading a vehicle into and from a carrier ship, and a carrier ship equipped with such a system.

More particularly, the disclosure relates to a system for loading/unloading a vehicle through at least one opening provided in the rear of said ship and which comprises an angled vehicle-receiving ramp associated with motor-driven means for loading/unloading the vehicle.

Such vehicles can for example consist of high-speed watercrafts or drones.

In particular, such watercrafts can be used by intervention teams combatting acts of piracy or various types of trafficking.

In these examples of applications, one can see that the loading/unloading means for the watercraft condition the operating quality of the carrier ship.

In fact, these means must allow fast, reliable, discrete, and safe loading and unloading of the watercraft.

Loading/unloading systems of this type already exist in the state of the art.

Examples include cranes, fore parts of ships, angled ramps, and hoisting winches or handling trolleys, or bridge cranes and doors opening to the outside of the ship.

Other examples of embodiments of systems of this type can be found in documents FR-A-2 660 915, U.S. Pat. No. 4,864,957 and US 2008/0202405.

However, all of these systems have a certain number of drawbacks, in particular in terms of their installation, speed of use, bulk, discretion, user safety, complexity, or the need for the carrier ship to adopt a certain attitude during loading/unloading of the vehicle.

It is also known that the implementation of this type of loading through the rear of the carrier ship has a certain number of advantages, including the fact that it is fast, can be done even when the ship is in motion, and is more discrete in terms of environmental impact.

In that case, a rear ramp is used that must be angled relative to the horizontal by an angle of about 15° to place the watercrafts or drones in the water.

However, the arrangements of the quarterdecks of carrier ships, in particular when they are equipped with a landing platform for aircrafts and sites installed thereunder, sometimes prevent such an angle.

Furthermore, the length of the loaded watercrafts and drones can for example reach 11 meters, such that a sharp angle on the ramp can prevent the loading of such a watercraft in a covered quarterdeck due to the limited height of the tween deck at that part of the ship.

However, it is known that the use of this type of intervention vessel is most often combined, for operational purposes, with the implementation of an aircraft, such as a helicopter or an onboard drone.

The aim of the disclosure is therefore to resolve these problems.

To that end, the disclosure relates to a system for loading/unloading a vehicle into and from a carrier ship through at least one opening provided in the rear of said ship, comprising an angled vehicle-receiving ramp combined with a motor-driven means for loading/unloading the vehicle, characterized in that the motor-driven means for loading/unloading the vehicle comprises a crossbeam-shaped means for the ship that extends above the ramp and is combined with a vehicle-hoisting/releasing cable, which is in turn combined with a first drive means for hoisting/releasing the vehicle, in that the crossbeam-shaped means is longitudinally movable, by means of a second drive means above the ramp, between a rear position for hoisting/releasing the vehicle and a front position for storing the vehicle on the ramp in the ship, and in that the crossbeam-shaped means comprise cradle-shaped means for pushing the vehicle when it is released, during the movement of said crossbeam-shaped means between their front and rear positions.

According to other aspects of the disclosure, the loading/unloading system comprises one or more of the following features:

- the crossbeam-shaped means comprise means forming a return pulley for the vehicle-hoisting/releasing cable,
- the transverse ends of the crossbeam-shaped means comprise movement pinions associated with the second drive means, said pinions being adapted to cooperate with longitudinal racks of the ship provided on either side of the ramp, to move the crossbeam-shaped means between their front and rear positions,
- the first drive means comprise a hydraulic winch for maneuvering the vehicle-hoisting/releasing cable, supported by the crossbeam-shaped means, and
- the second drive means comprise at least one hydraulic motor for actuating the pinions, supported by the crossbeam-shaped means.

The disclosure also relates to a carrier ship, characterized in that it comprises at least one such loading/unloading system.

This ship comprises one or more of the following features:

- it comprises two systems arranged symmetrically on either side of the longitudinal axis of said ship,
- each opening of the ship is associated with door panels that can be moved by pivoting around lateral hinge means on the rest of the ship, between opening and closing positions via motor-driven actuators,
- each opening is associated with two symmetrical door panels, and
- the actuators for moving the door panels comprise hydraulic cylinders.

BRIEF DESCRIPTION OF THE DRAWINGS

The disclosure will be better understood using the following description, provided solely as an example and done in reference to the appended drawings, in which:

FIG. 1 illustrates a top view of a rear part of a carrier ship designated by general reference 1, equipped with at least one vehicle-loading/unloading system, according to the disclosure.

Figure 1:
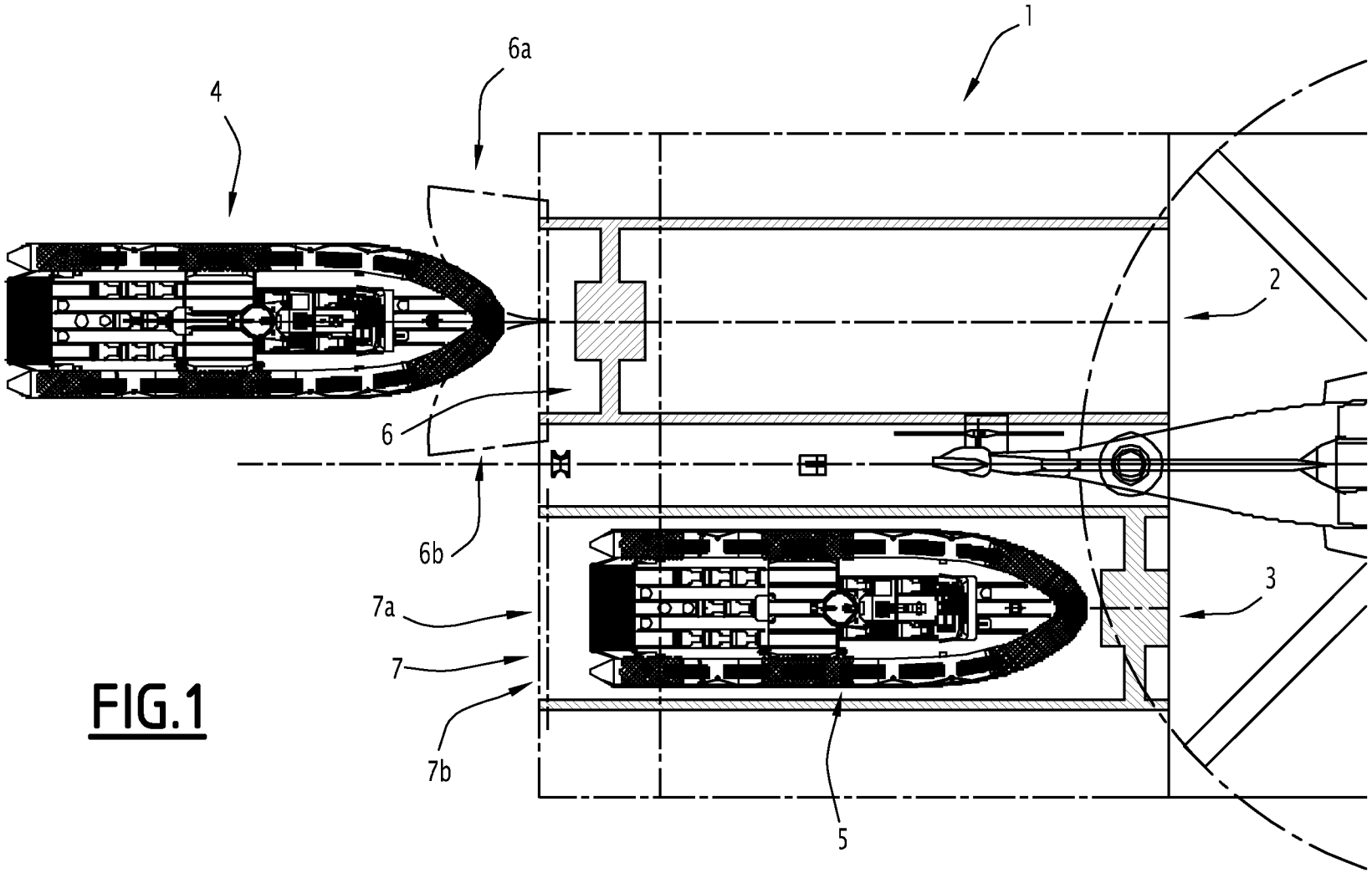
FIG. 1 shows a top view of the rear part of a carrier ship equipped with loading/unloading systems according to the disclosure.

In fact and in the illustrated example, the ship 1 comprises two systems according to the disclosure, arranged symmetrically on either side of the longitudinal axis of that ship, said systems respectively being designated by references 2 and 3, and making it possible to load and unload watercrafts, for example of the high-speed watercraft type, designated by general references 4 and 5.

It will be noted that the loading/unloading system designated by general reference 2 is in the recovery and/or release position of the watercraft 4, while the loading/unloading system 3 is in the storage position of the watercraft 5 in the ship.

In fact, each loading/unloading system is then associated with an opening provided at the rear of the ship, 6 and 7, respectively, each of which is associated with door panels that can be moved by pivoting around lateral hinge means on the rest of the ship, between an opening position as illustrated for the opening 6 and a closing position, as illustrated for the opening 7.

The movements of these door panels are ensured via motor-driven movement actuators that may for example comprise hydraulic or other cylinders.

To that end, it will be noted that each opening is then associated with two symmetrical door panels 6*a* and 6*b,* and 7*a* and 7*b,* respectively.

Figure 2:
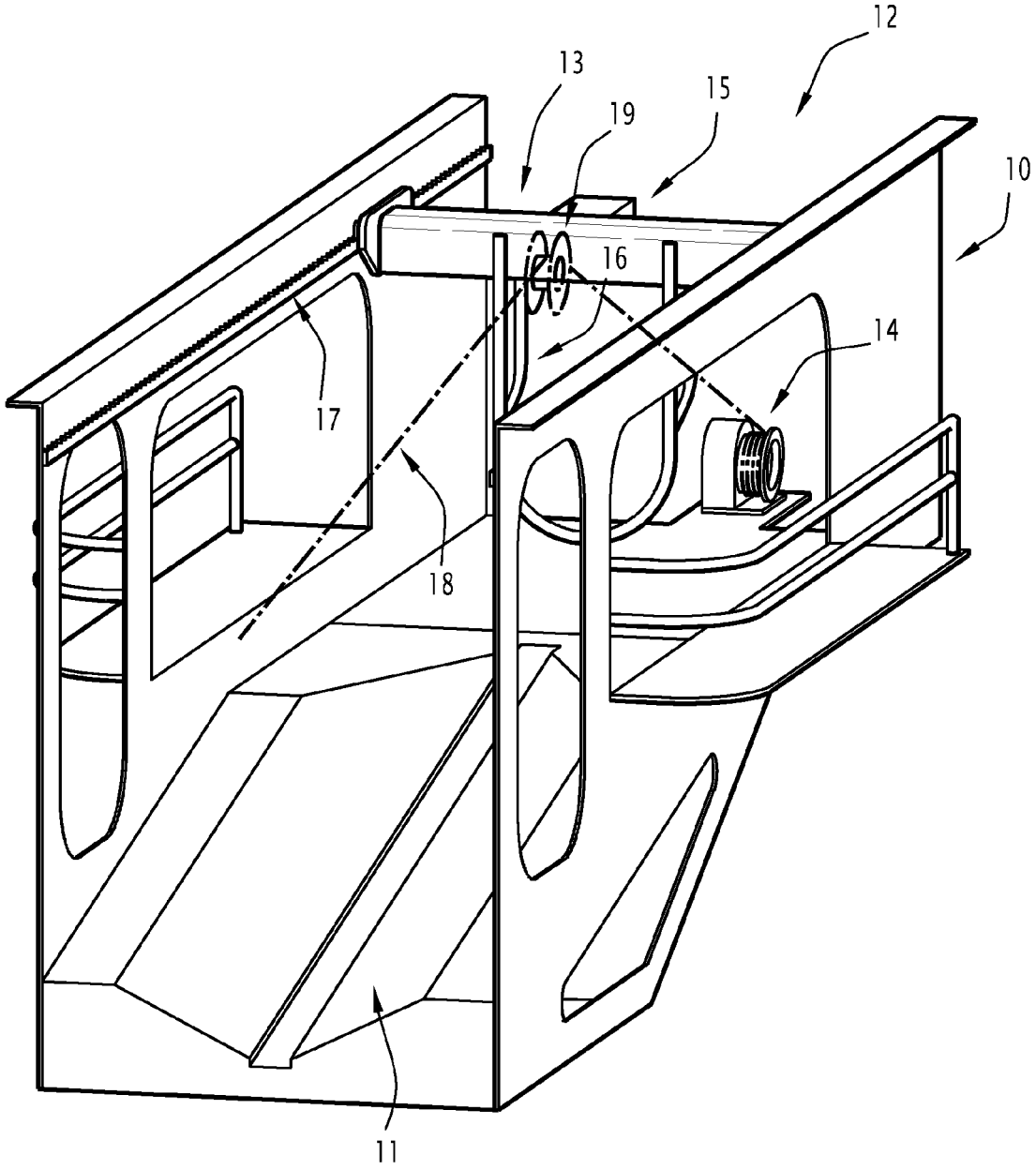
FIG. 2 shows a perspective view of a loading/unloading system according to the disclosure.

A more detailed illustration of an embodiment of a loading/unloading system according to the disclosure is provided in FIG. 2.

This system is designated by general reference 10 and then allows the loading/unloading of a vehicle into and from a carrier ship that comprises an inclined vehicle-receiving ramp, said ramp being designated by general reference 11 and being associated with vehicle-loading/unloading drive means, said means being designated by general reference 12.

In fact, the vehicle-loading/unloading drive means comprise transverse crossbeam-shaped means of the ship, designated by general reference 13, extending above the ramp 11 and associated with a vehicle-hoisting/releasing cable, which in turn is associated with first drive means designated by general reference 14 in that FIG. to hoist/release the vehicle.

Furthermore, the crossbeam-shaped means 13 can be moved longitudinally via second drive means, as designated by general reference 15 in said FIG. 2, above the ramp 11, between a rear vehicle-hoisting/releasing position and a front position for storing the vehicle on the ramp of the ship, as illustrated in FIG. 1.

As will also be described in more detail hereafter, the crossbeam-shaped means comprise return pulley means for the vehicle-hoisting/ releasing means, and cradle-shaped means 16, for pushing the vehicle when it is released, during the movement of said crossbeam-shaped means between their front position and rear position, when the vehicle is released.

It will also be noted that the transverse ends of the crossbeam-shaped means can comprise movement pinions associated with the second drive means 15, said means being adapted to cooperate with longitudinal racks of the ship provided on either side of the ramp, to move the crossbeam-shaped means between their front and rear positions.

One of these racks is for example designated by general reference 17 in said FIG. 2.

Different embodiments of the riven means can be considered, but it will be noted that the first drive means can for example comprise a hydraulic winch for maneuvering the vehicle-hoisting/releasing cable, which may or may not be supported by the crossbeam-shaped means, i.e. fixed on the rest of the ship, while the second drive means can comprise at least one hydraulic motor for actuating the pinions, supported by the crossbeam-shaped means.

Of course, other embodiments can also be considered.

FIGS. 3 to 8 show side views of the rear of the carrier ship, respectively illustrating the loading and unloading phases of the watercraft.

In these Figs., the carrier ship is still designated by general reference 1, the ramp by general reference 11, the movable crossbeam by general reference 13, the winch by general reference 14, said winch being associated with a cable for hoisting/releasing the watercraft, said cable being designated by general reference 18.

The return pulley-shaped means are also shown for this vehicle-hoisting/releasing cable, said pulley-shaped means being designated by general reference 19 and the cradle-shaped means for pushing the watercraft, designated by general reference 16.

These Figs. also show the opening 6 at the rear of the ship and one of the door panels 6*a,* as well as the watercraft 4.

Figure 3:
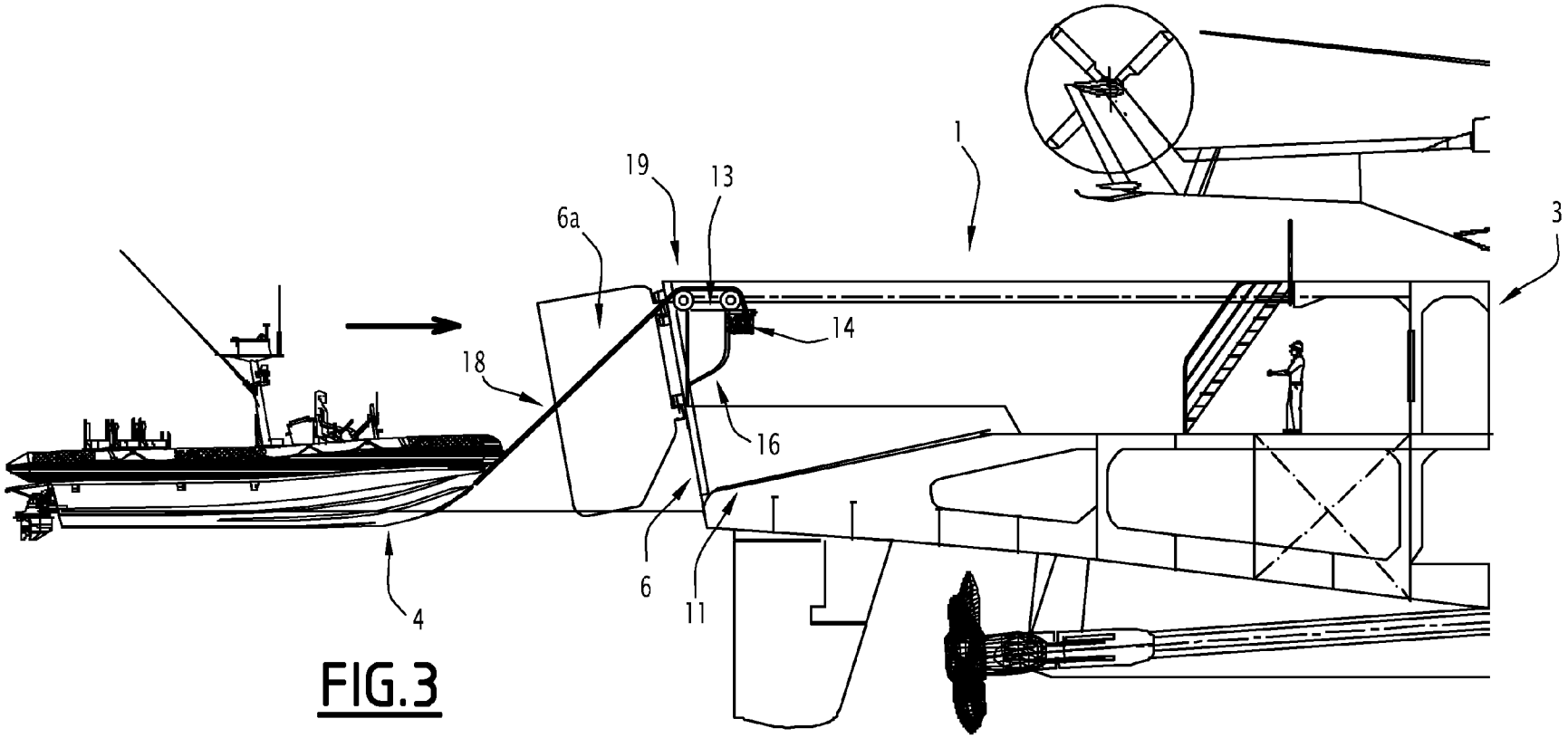
FIGS. 3 to 8 show different views illustrating a loading and an unloading phase into and from a carrier ship.

FIG. 3 illustrates a step of the loading phase in which the movable crossbeam is in the rear position, the hoisting cable is unwound, and its free end is fastened to the watercraft 4. The opening panels at the rear of the ship are of course in the open position.

Figure 4:
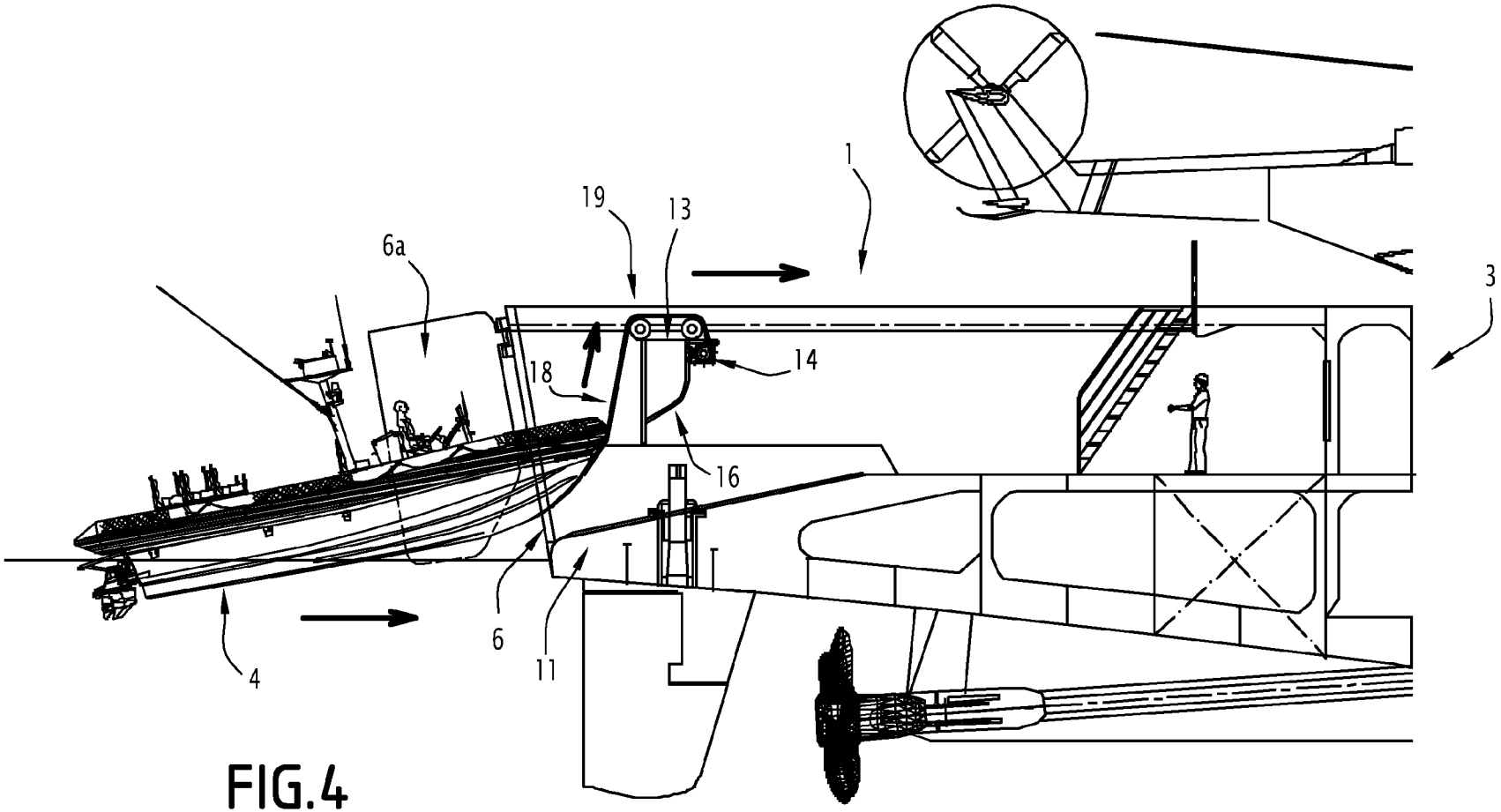

During this loading phase, the first operation consists of maneuvering the hoisting winch to quickly raise the front of the watercraft, so as to allow it to cross the corresponding end of the ramp, as illustrated in FIG. 4.

Figure 5:
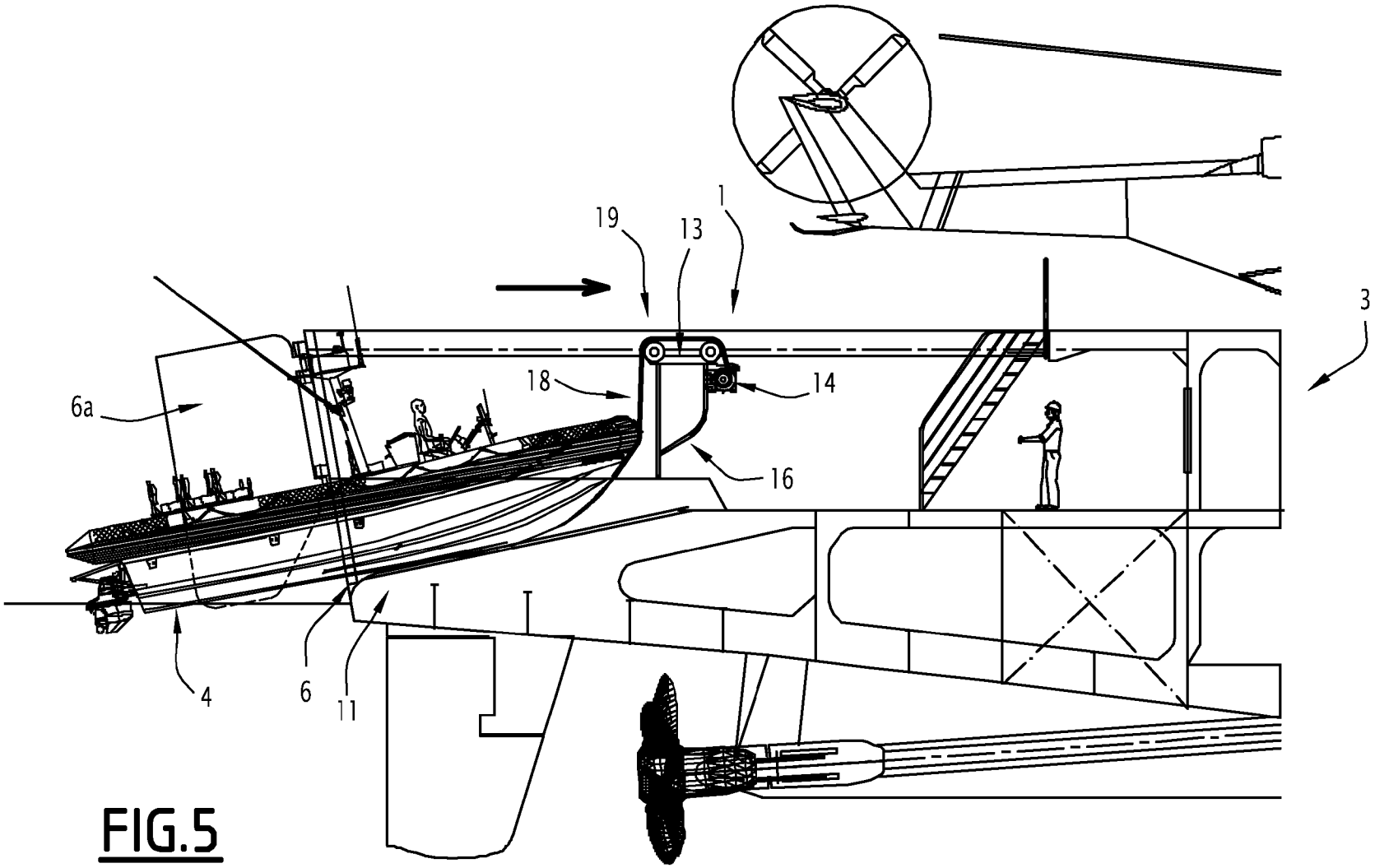
Figure 6:
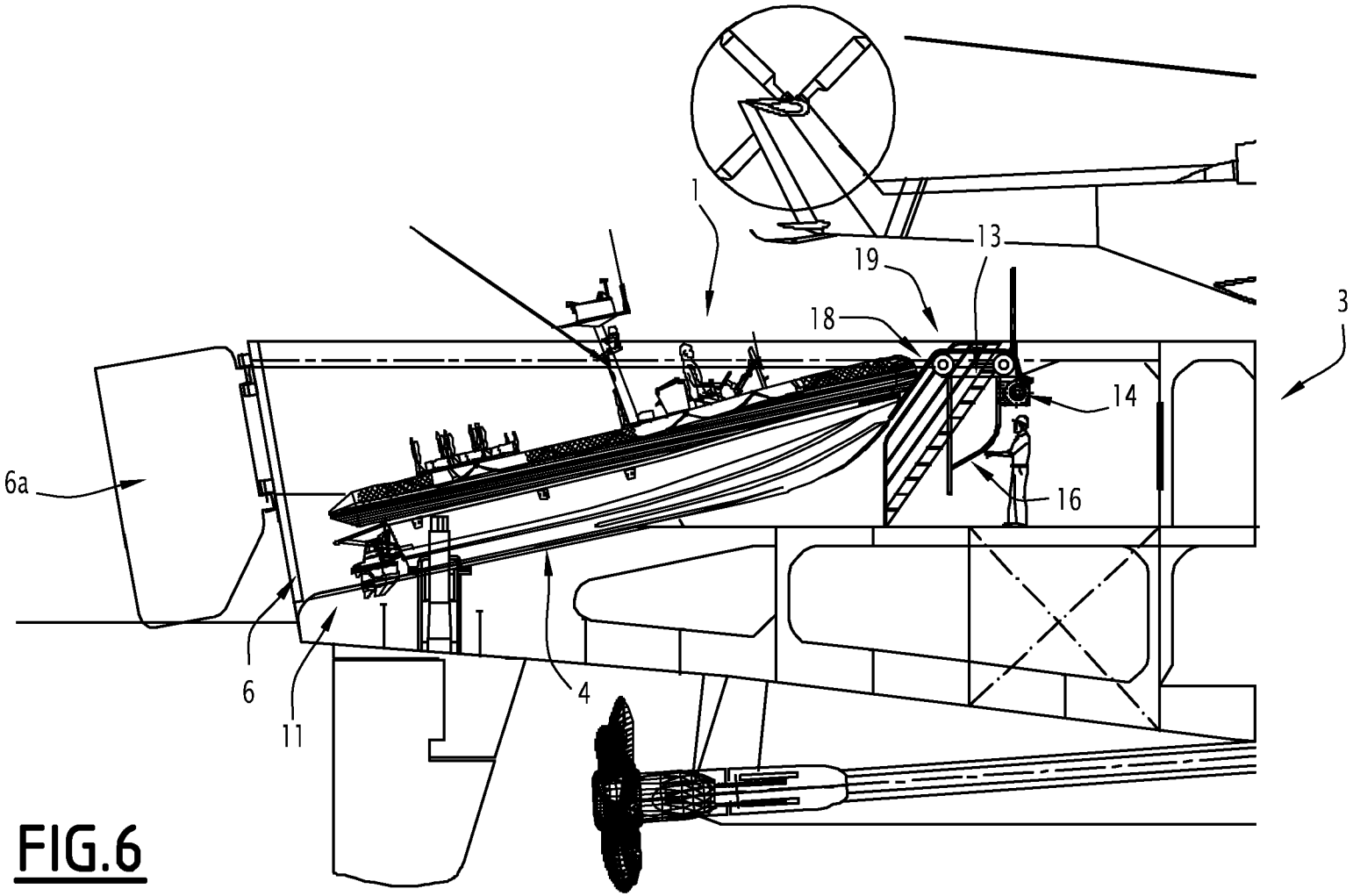

The movable crossbeam 13 can then be moved forward so as to pull the watercraft 4 onto the ramp 11, as illustrated in FIG. 5, as far as its storage position illustrated in FIG. 6.

In this position, the watercraft can then be secured and the rear opening of the ship closed.

The operations for putting the watercraft in the water are done in the opposite order.

Figure 7:
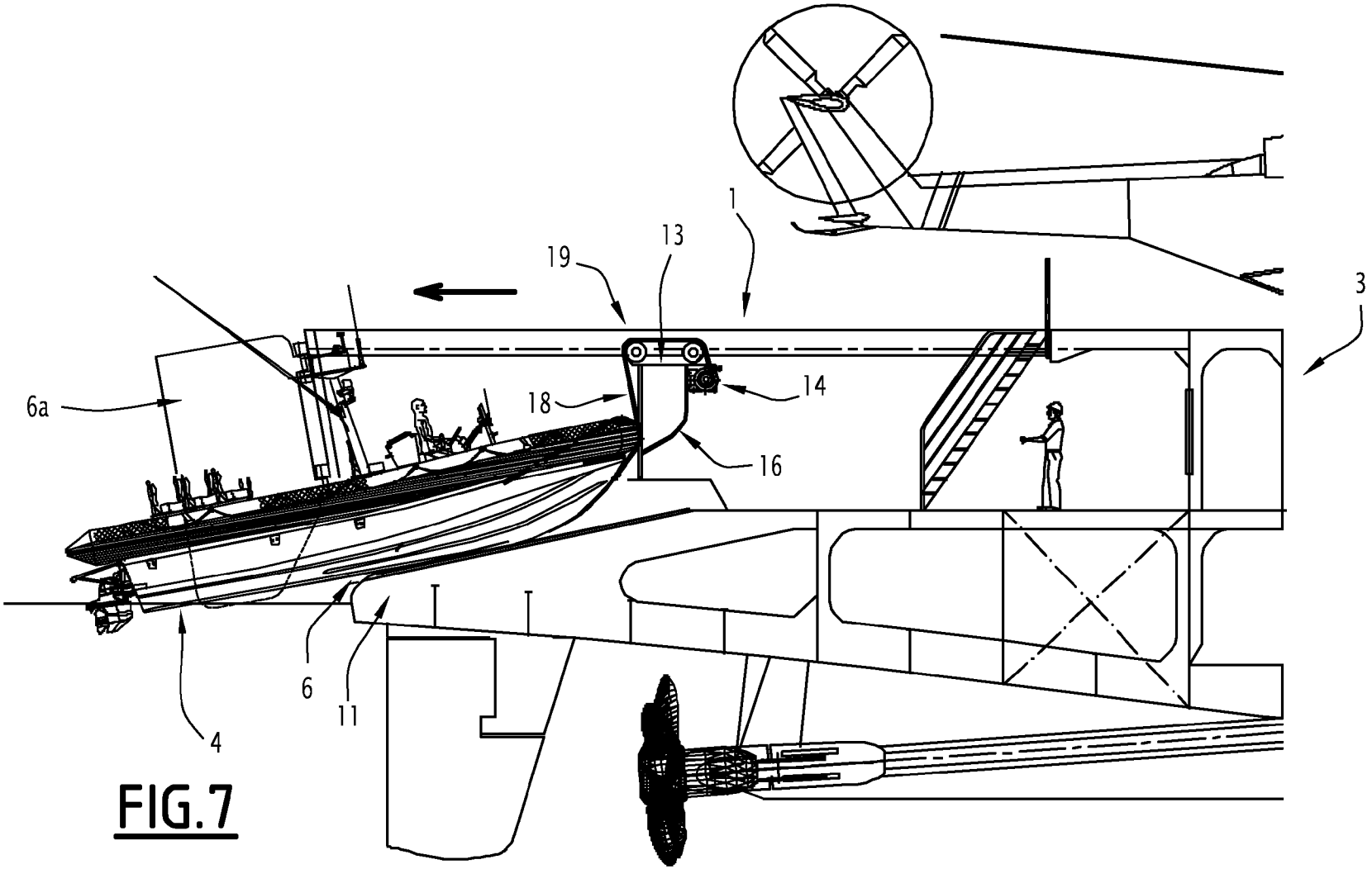

Thus, the rear door of the ship is first opened, then the movable crossbeam 13 is moved toward its rear position so that the cradle 16 pushes the front of the watercraft 4, so as to pull it back on the ramp 11 as illustrated in FIG. 7.

Figure 8:
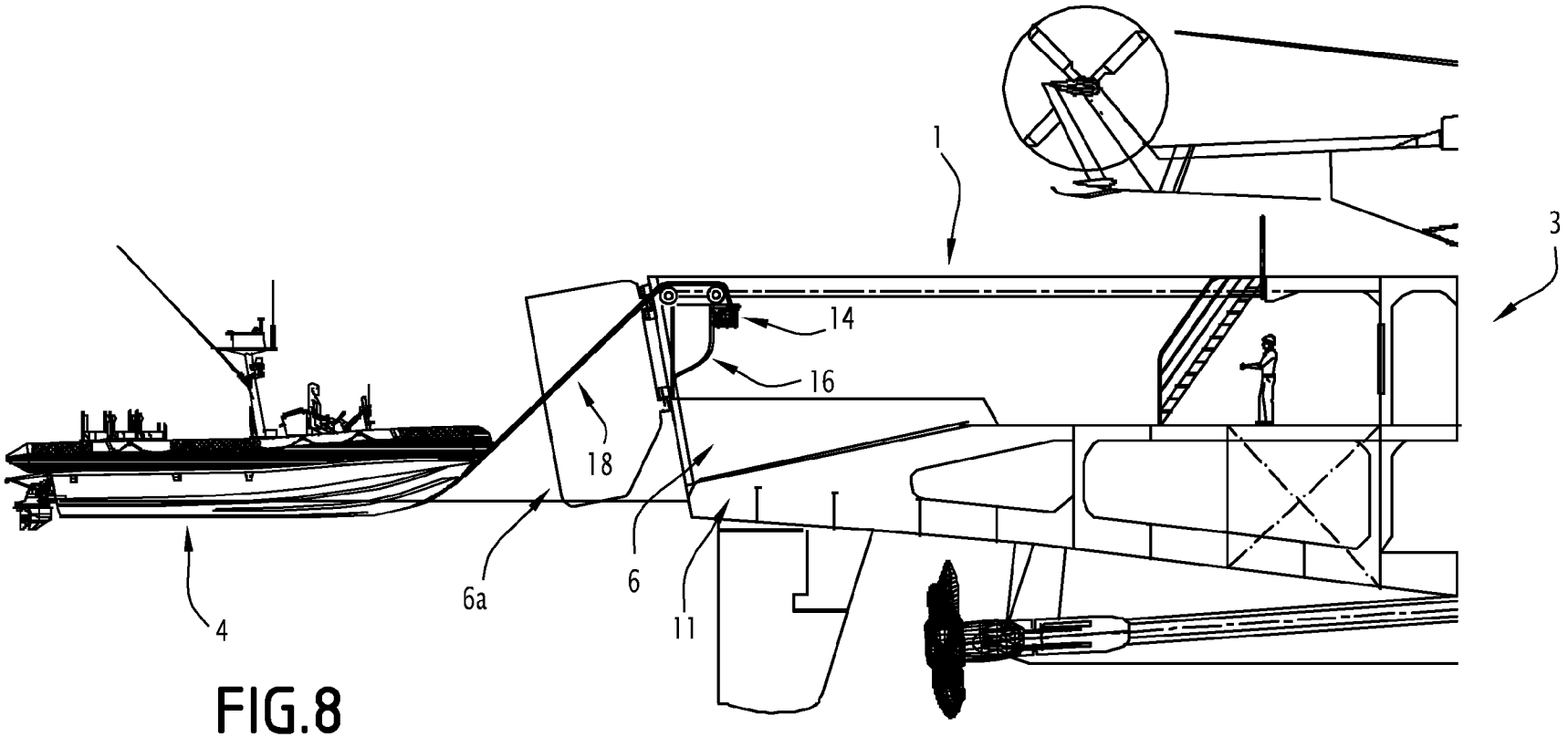

Once the back of the watercraft is in the water, and the crossbeam 13 is in the rear position, the cable 18 is unwound so as to allow the watercraft 4 to be completely in the water, as illustrated in FIG. 8.

It will be noted that all of these maneuvers can be driven from a dashboard onboard the ship, or controlled by a dashboard of control means offboard in the watercraft and that then allow the personnel on that watercraft for example to interrupt a loading maneuver in case of emergency.

One can thus see that such a loading/unloading system has a certain number of advantages, inasmuch as it has a high lifting point and allows quick pulling out of the watercraft when it is loaded.

It will also be noted that the loading/unloading system according to the disclosure does not require a submerged ramp portion or door and that the implementation of the loading can be done by the water surface.

Different embodiments of this system and its members can of course also be considered.

Thus for example, means other than cylinders or hydraulic motors, or hydraulic winches, can be considered.

Likewise, drive means associated with the watercraft-hoisting/releasing cable can be supported by the crossbeam or fixed on the rest of the carrier ship.

The invention claimed is:

1. A system for loading/unloading a vehicle into and from a carrier ship through at least one opening provided in the rear of the ship, comprising an angled vehicle receiving ramp combined with a motor-driver for loading/unloading the vehicle, wherein the motor-driver for loading/unloading the vehicle comprises a crossbeam for the ship that extend above the ramp and is combined with a vehicle-hoisting/releasing cable, which is in turn combined with a first driver for hoisting/releasing the vehicle, and wherein the crossbeam is longitudinally movable, by means of a second driver above the ramp, between a rear position for hoisting/releasing the vehicle and a front position for storing the vehicle on the ramp in the ship, and wherein the crossbeam comprises a cradle for pushing the vehicle when it is released, during the movement of the crossbeam between its front and rear positions.

2. The system for loading/unloading a vehicle according to claim 1, wherein the crossbeam comprises a return pulley for the vehicle-hoisting/releasing cable.

3. The system for loading/unloading a vehicle according to claim 1, wherein the crossbeam has transverse ends, the transverse ends comprising movement pinions associated with the second driver, the pinions being adapted to cooperate with longitudinal racks of the ship provided on either side of the ramp, to move the crossbeam between its front and rear positions.

4. The system for loading/unloading a vehicle according to claim 1, wherein the first driver comprises a hydraulic winch for maneuvering the vehicle-hoisting/releasing cable.

5. The system for loading/unloading a vehicle according to claim 3, wherein the second driver comprise at least one hydraulic motor for actuating the pinions, supported by the crossbeam.

6. A carrier ship, comprising at least one loading/unloading system for a vehicle according to claim 1.

7. A carrier ship according to claim 6, comprising two loading/unloading systems, wherein these two loading/unloading systems are arranged symmetrically on either side of the longitudinal axis of the ship.

8. The carrier ship according to claim 6, wherein each opening of the ship is associated with door panels that can be moved by pivoting around a lateral hinge on the rest of the ship, between opening and closing positions via motor-driven actuators.

9. The carrier ship according to claim 8, wherein each opening is associated with two symmetrical door panels.

10. The carrier ship according to claim 8, wherein the actuators for moving the door panels comprise hydraulic cylinders.

* * * * *

UNITED STATES PATENT AND TRADEMARK OFFICE

CERTIFICATE OF CORRECTION

PATENT NO. : 8,671,866 B2
APPLICATION NO. : 13/498080
DATED : March 18, 2014
INVENTOR(S) : Christian Peuziat et al.

It is certified that error appears in the above-identified patent and that said Letters Patent is hereby corrected as shown below:

On the Title Page, left column (Item 86), please delete "PCT/FR2010/005182" and insert therefore --PCT/FR2010/051827--.

Signed and Sealed this
Second Day of December, 2014

Michelle K. Lee

Michelle K. Lee
*Deputy Director of the United States Patent and Trademark Office*